United States Patent [19]

Kuiper

[11] Patent Number: 4,643,504

[45] Date of Patent: Feb. 17, 1987

[54] LAMPHOLDER ASSEMBLY FOR LOOP-, U- OR PI-SHAPED GAS DISCHARGE OR FLUORESCENT LAMPS WITH A SINGLE LAMP CAP

[76] Inventor: Adrianus M. Kuiper, Lisstraat 27, Landsmeer, Netherlands, 1121 AR

[21] Appl. No.: 722,225

[22] PCT Filed: Jul. 18, 1984

[86] PCT No.: PCT/NL84/00022

§ 371 Date: Mar. 20, 1985

§ 102(e) Date: Mar. 20, 1985

[87] PCT Pub. No.: WO85/00700

PCT Pub. Date: Feb. 14, 1985

[30] Foreign Application Priority Data

Jul. 20, 1983 [NL] Netherlands ..... 8302595
Jun. 25, 1984 [NL] Netherlands ..... 8402000

[51] Int. Cl.[4] ..... H01R 33/08
[52] U.S. Cl. ..... 339/51; 339/50 R
[58] Field of Search ..... 313/493; 315/57, 58; 339/50 R, 51

[56] References Cited

U.S. PATENT DOCUMENTS

| | | | |
|---|---|---|---|
| 2,288,939 | 7/1942 | Curtis | 339/51 |
| 2,298,824 | 10/1942 | Darley | 362/219 |
| 2,449,394 | 9/1948 | Kulka | 339/51 |
| 2,592,142 | 4/1952 | Holm | 339/51 |
| 2,702,378 | 2/1955 | Talty | 339/50 R |
| 2,907,872 | 10/1959 | Wilson | 339/50 R |
| 3,353,140 | 11/1967 | Johnson | 339/56 |
| 3,426,234 | 2/1969 | Hayasaka et al. | 339/50 R |
| 3,582,866 | 6/1971 | Johnson et al. | 339/50 |

FOREIGN PATENT DOCUMENTS

| | | | |
|---|---|---|---|
| 1007433 | 5/1957 | Fed. Rep. of Germany | 339/50 R |
| 1127467 | 4/1962 | Fed. Rep. of Germany . | |
| 838631 | 5/1952 | Fed. Rep. of Germany . | |
| 1069157 | 7/1954 | France . | |
| 1189467 | 4/1970 | United Kingdom . | |
| 2077488 | 12/1981 | United Kingdom . | |

*Primary Examiner*—Gil Weidenfeld
*Assistant Examiner*—Gary F. Paumen
*Attorney, Agent, or Firm*—Weingarten, Schurgin, Gagnebin & Hayes

[57] ABSTRACT

A lampholder for use with single ended, gas discharge lamp such as fluorescent lamps, and a ballast comprising a unitary housing into which all elements necessary for the operation of a gas discharge lamp may be directly inserted. The resulting lampholder may then be connected directly to the power supply eliminating the need for additional interconnection parts and steps necessary to provide a complete lamp circuit.

7 Claims, 23 Drawing Figures

LAMPHOLDER ASSEMBLY FOR LOOP-, U- OR PI-SHAPED GAS DISCHARGE OR FLUORESCENT LAMPS WITH A SINGLE LAMP CAP

The invention relates to a lampholder assembly for receiving one or more loop-, u- or pi-shaped gas discharge or fluorescent lamps with a single lamp cap to be electrically connected to a ballast and the electrical contacts of the electrical power supply.

BACKGROUND OF THE INVENTION

This type of lamp is generally known, as is evident from the brochures of lamps with trade names such as PL, PLC, Dulux, 2D and Lynx. The invention also relates to a lampholder assembly for one or more loop-, u- or pi-shaped gas discharge or fluorescent lamps with a single lamp cap, to be electrically connected to a ballast, a starter belonging to the lamp and the electrical contacts of the electrical power supply.

The invention is of special importance to those lighting fixtures, or parts thereof, with which the lamp and ballast and, if required, the relative starter are mounted together.

The pi-shaped gas discharge or fluorescent lamp comprises two or more glass fluorescent tubes, located parallel to one another, or in any spatial relationship, and joined together at one or both ends of the glass fluorescent tubes, so that one continuous glass fluorescent tube is formed, at least both ends of which are connected with a single lamp cap, which lamp cap is provided with at least two electrical pin or similar contacts for fitting into the lampholder.

The loop- or u-shaped gas discharge or fluorescent lamp comprises one or more loop- or u- shaped glass fluorescent tubes, of which at least the ends are connected with a single lamp cap, whereby the lamp cap is provided with at least two electrical pin or similar contacts for fitting into the lampholder.

The single lamp cap or base of the loop-, u- or pi-shaped gas discharge or fluorescent lamp is usually provided with an integrated starter. When the lamp cap does not have an integrated starter, however, the loop-, u- or pi-shaped gas discharge or fluorescent lamp has to be electrically connected with a separate starter accessory, for which the lamp cap is provided with two additional electrical pin or similar contacts. It is evident that the invention relates to lampholders for any shape and size of the earlier described lamp cap and for any shape and size of the loop-, u- or pi-shaped gas discharge or fluorescent tubes and for any given spatial relationship of the lamp cap and the fluorescent tube or tubes connected to it. The described lamp can also be provided with additional electrical contacts for power control.

The loop-, u- or pi-shaped gas discharge of fluorescent lamp with a single lamp cap, hereafter called the PL lamp or lamp, is obtainable on the market in different designs and under various trade names, as previously mentioned. In order to connect the PL lamp, with integrated or separate starter, to the electrical power supply a ballast must be incorporated, in accordance with the relative connecting diagram. On those ballasts which have been developed and put on the market by various manufacturers for this purpose, one or two, and in the future possibly more, PL lamps can be connected to each ballast, in accordance with the relative connecting diagram. The ballast can have any function.

The invention is also of importance for the lighting fixtures, or parts thereof, with which the lamp and ballast and any starter accessory are mounted together with a reflecting or backing plate, whether or not constructed to be combined as heatshield and a possible housing for the ballast.

In existing lampholders, according to the current state of the art, the PL lamps are fitted into the lampholder by means of a lamp cap with electrical pin contacts, where the relative connections between PL lamp, or PL lamps, any necessary starters, ballast and electrical power supply are effected by wiring in accordance with the relative connecting diagram, where for the connection to the PL lamp the existing lampholders only function as an intermediary connecting device.

The aforementioned procedure and method for connecting the PL lamps, ballast and any starters to the electrical power supply does provide a problem, in that the wiring has to be done in accordance with a relative connecting diagram.

Another drawback of existing lampholders, according to the current state of the art, is that the various electrical and any optical parts are mounted separately in the lighting fixtures, or parts thereof, and are mechanically fastened, which entails the use of mechanical aids, such as clamps and screws, all of which implies a considerable amount of extra work in addition to the above wiring procedure.

A disadvantage of lighting fixtures with existing lampholders is that the internal connecting elements are too easily visible. These problems have a detrimental effect on the using of the energy saving PL lamp, as opposed to the incandescent lamp which does not have these drawbacks. Another specific disadvantage of the existing lampholders for PL lamps, at present available on the market, is that because of a two-sided clamping of a single lamp cap, through a spring in the lampholder, the lamp cap can become slightly out of alignment in the lampholder and a parallel mounting with the possible use of a reflecting or backing plate is difficult and requires additional mechanical aids.

SUMMARY OF THE INVENTION

The lampholder in accordance with the invention, as described in this application, eliminates the above disadvantages of existing lampholders according to the current state of the art. The lampholder in accordance with the invention has the advantage that it is possible to efficiently assemble a PL lighting unit, or basic lighting unit, for connection to the electrical power supply as an electrically and mechanically integrated unit, which looks aesthetically attractive and can be built into lighting fixtures.

The lampholder in accordance with the invention is, thus, a structural unit, by means of which several parts are electrically and mechanically connected together. For this reason, the lampholder also could be called an adaptor or lampholder unit. Since, however, such terms for this procedure are unknown, these words are not used in this application for patent. The lampholder in accordance with the invention will merely be referred to as the lampholder or lampholder assembly.

The lampholder in accordance with the principles of the invention has advantages provided by not having to do wiring and not having to use additional mechanical aids, furthermore there are no disadvantages. The invention, as specified in this application for patent, aims at eliminating the aforementioned disadvantages of the use of the PL lamp and relates to a lampholder assembly of the type described in the title of this application, which lampholder is characterized in that the lampholder is provided with internal electrical interconnections, so that the lampholder can be directly connected to the ballast by means of the electrical contacts, whereby the lampholder is also provided with the electrical contacts for the electrical power supply. In accordance with a preferred embodiment, the lampholder can also be directly connected to the ballast with the aid of a separate mechanical connection. Provision can be made for electrical contacts for connecting a separate starter, if required.

The electrical interconnections can also be made in such a way that the lampholder is integrated with the ballast, where the lampholder can be constructed so that the PL lamp and the ballast are located next to, or above each other in the finished lighting unit. Another lampholder assembly can have at least two PL lamps, with or without separate starter, in the finished lighting unit, located next to each other above the ballast.

It is also possible to make such a lampholder assembly for any given spatial relationship of PL lamp and ballast, with regard to each other or to the surroundings.

The internal electrical interconnections and the electrical contacts in the lampholder can be incorporated into the body of the lampholder, for example by moulding in plastic.

The lampholder casing can consist of at least two sections, of plastic for example, whether or not hinged together, having at least one common tangent plane, with recesses and protrusions in at least one part of the lampholder casing in the tangent plane, for fitting the electrical contacts and the internal electrical interconnections into the lampholder, whereby these parts can be integrated or could be spring mounted or constructed as a spring element, so that when the two sections of the lampholder are clamped together an electrical connection is made between the electrical contacts which have to be connected together. For the internal electrical interconnections a printed circuit can be used with a separate printed circuit board, or the printed circuit can be attached to at least one internal surface of the lampholder sections, whereby, if the printed circuit is attached on more than one surface, crossing of the interconnections can be realised and parts of the printed circuit can be joined together and, if required, transferred from one surface to another. The printed circuit can be completely, or partially, coated with an electrically insulative layer.

The lampholder can be electrically connected to the ballast by means of electrical pin, pen, wire, strip or similar contacts on the ballast. The lampholder can be constructed in such a way, that should a separate starter be required, the starter can be connected to the lampholder by means of electrical pin, wire, strip or similar contacts on the starter. In one embodiment of the lampholder it is possible to attach a reflecting or backing plate, whether or not combined with a free of play one-sided clamping of the lamp cap of the PL lamp in the lampholder, which parts can be incorporated in a lighting fixture, or to a part of same. One great advantage of the invention is that when assembling a PL lighting unit, the relative connections in accordance with the relative connecting diagram and in accordance with a relative design of a lighting fixture, can be made without wiring and with less mechanical aids. The invention will provide a powerful stimulus for efficiently making new energy saving PL lighting units, which look aesthetically attractive. A more comprehensive description of the invention will now be given.

As has already been described, the lampholder can be constructed for connecting one PL lamp to a ballast and the electrical power supply, as well as for connecting several PL lamps to a ballast and the electrical power supply. In the embodiment of the twin or multiple-type lampholder, it follows that a lighting unit provided with this type of lampholder will only function if the number of PL lamps located in the lampholder, which are connected in series, is the same as the number of the connections for the PL lamps, whereby there is a possibility for the missing electrical connections, such as for example a missing lamp in a two lamp system, to be compensated for by provisions within the lampholder, as for example a switchable internal interconnection between the electrical contacts of one fitting of the twin-type lampholder, or can be compensated for by fitting an external plug-type interconnection into that fitting of the twin-type lampholder where the lamp is missing, whereby the lampholder can be so constructed that the interconnection plug can only be fitted into one of the two fittings of the twin-type lampholder, and can not be fitted into the single-type lampholder.

As already mentioned at the beginning of the application, the single-type lampholder can be so constructed that the PL lamp is located in a parallel position above, or next to the ballast. An embodiment of a twin-type lampholder can be constructed so that the PL lamps are located parallel to one another, above the ballast. There are, of course, several other possible embodiments of the lampholder, particularly with regard to the spatial relationship of the PL lamps and ballast, in respect of each other and the surroundings. It is, therefore, possible to have an embodiment of the lampholder in which a PL lamp or PL lamps and ballast are located either perpendicular to each other, parallel, or in alignment, or an embodiment made by combinations or intermediate forms of these. The lampholder can be constructed for one or more PL lamps without integrated starter in the lamp cap, whereby with each PL lamp a separate starter must be connected in parallel connection, independent of the series, whereby the separate starters can be provided with electrical pin, pen, wire, strip or similar contacts for direct connection to additional electrical contacts on, or in, the lampholder, and the relative additional electrical pin or similar contacts on the PL lamps can be connected to relative additional electrical contacts in the lampholder, whereby the lampholder must be provided with relative additional electrical interconnections. With the design and dimensions of the lampholder, the shape and size of the parts to be joined together, namely the PL lamp or PL lamps, the ballast, lighting fixture, any reflecting or backing plate to be applied and any starter to be connected separately, must, of course, be reckoned with. Similarly, the desired spatial relationship of the PL lamp or lamps in respect of each other, the ballast and the surroundings will influence the design and dimensions of the lampholder. The measurements and weight of the available ballasts has a considerable influence on the shape and size of the lampholder and on the method of mounting it. Thus, with the use of the electric ballast at present available, this part is the heaviest and can be fixed to the surroundings so that the lampholder can be connected to the ballast, as will be explained later. In the future there will be electronic ballasts, with smaller dimensions and less weight, through which it will be possible for the lampholder to be connected to the surroundings and to connect the ballast to the lampholder by means of electrical pin, pen, wire, strip of similar contacts The lampholder offers possibilities for further integration of the lampholder with an electronic ballast, which will be small in size and can have a printed circuit board with the electronic components on it, by directly connecting the printed circuit board of the electronic ballast to the lampholder's electrical contacts for the ballast, and fitting it into the lampholder, which possibility also applies for fitting an electronic starter into the lampholder, if required. In connection with the above, the embodiment of the lampholder with a separate printed circuit board in the lampholder offers the possibility to carry the integration still further, by attaching the electronic components of the ballast and any starter and the relative wiring to the printed circuit board of the lampholder. For manufacturing the different variations of the form and construction of the printed circuit board, a flexible wiring and mounting technique can be applied. The advantage of assembling the electronic components of ballast and any starter withthe lampholder, instead of assembling these electronic components into the lamp cap, is, that the number of, so called, burning hours of the lamp is smaller than the working hours of the electronic components.

In the drawings of this application, which depict possible embodiments of the lampholder, the existing shapes and sizes of the available electrical or electronical parts to be connected to the lampholder, such as the ballast and any starter, have always been used as a basis, but however, when smaller electrical or electronical parts are connected with or fitted into the lampholder, these can be located in one or more in- or external recesses in the lampholder, whereby, when the electrical contacts are constructed with spring elements, as described in this application, the electrical contact can be achieved by locking or closing the lampholder, in which case, of course, shape and size of the interior and exterior of the lampholder can be suitably adapted.

In the embodiment descriptions and in the claims, the various possible arrangements of the lampholder and the relative spatial relationships of the parts to be connected have not been gone into further, because these are obviously considered as part of the invention.

In a lampholder assembly in which the electrical contacts for the ballast and the electrical contacts for the electrical power supply are identical or interchangeble, the lampholder has two possibilities for the positioning of the lampholder, and thus of the lamp, in respect of the ballast and the surroundings; for example, lamp and ballast in alignment or perpendicular to one another, or in alignment or parallel. For certain purposes, it is prescribed that the non-current carrying metal parts of the lighting installations must be earthed. This can be done by constructing the lampholder in a preferred embodiment, with electrical earthing contacts and metal interconnections for earthing the non-current carrying metal parts of the electrical parts which are to be connected to the lampholder.

The electrical interconnections of the lampholder can be made internally in the lampholder or externally on the lampholder, with an electrically insulative layer that may be provided.

The electrical contacts of the lampholder, for connecting the electrical parts to the lampholder, are, preferably, made internally. The internal electrical contacts and electrical interconnections in the lampholder can be realised by construction of the lampholder casing by means of an injection moulding process in plastic for example, with the electrical contacts and electrical interconnections, such as wiring or other conductive metal parts, moulded-in. The internal electrical interconnections in the lampholder can also be made of metal parts or strips, which can be connected to the metal electrical contacts inside the lampholder by constructing the lampholder as an injection moulding casing, which can be clamped shut, which casing can be made of nonconductive material, such as plastic, with holes externally in the casing for the electrical connections of the electrical parts to be connected to the lampholder, whereby the injection moulding casing can be composed of two or more sections, whether or not hinged together, with a common tangent plane and recesses with protrusions in at least one of the sections, for the electrical contacts and the electrical interconnections which have to be fitted into it. The locking mechanism of the lampholder sections can be moulded in and contructed in such a way, that when the lampholder sections are shut they are interlocked, while also screws can be used to clamp both sections together, or an ultrasonic weld for example.

The hinged contruction between the lampholder sections can be moulded in with the lampholder sections which can be clamped shut. The common tangent plane of the lampholder sections can be made to overlap each other. As is evident from the above, the lampholder sections can also be manufactured separately, without a moulded hinged connection, or as an open casing with a cover.

When the electrical contacts and electrical interconnections are fitted into the recesses and between the protrusions, they can be clamped in such a way, that when clamping the lampholder sections together, the electrical contacts and the electrical interconnections remain in place. The internal electrical interconnections can be constructed as metal parts in such a way, that they are integrated with the electrical contacts for the electrical parts to be connected to the lampholder.

The possible external electrical interconnections of the lampholder can be made with insulated wiring or with a printed circuit or circuits with an electrically insulative layer.

The internal electrical interconnections of the lampholder can also be realised by producing the lampholder casing in two sections, with recesses and protrusions or with protruding edges in the recesses in the surface or common tangent plane of at least one lampholder section, and fitting or attaching the wiring circuit, whether or not printed, completely or partly, into the recesses or onto each of the respective surfaces or protrusion planes of the section or sections, whereby the tangent plane or surface of at least one section can be provided in such a way with recesses and protrusions that, if necessary, the wiring circuit can be crossed or be transferred at one or more points from one surface to another and by so doing make interconnection possible between the relative electrical contacts of the lampholder. When using a printed circuit for the electrical interconnections of the lampholder, a printed circuit board, whether or not provided with the electrical contacts for the electrical parts to be connected to the lampholder, can be used and fitted inside the lampholder, by constructing the lampholder with an injection moulding casing which can be openend and shut, whereby the lampholder is externally provided with holes for the electrical contacts of the electrical parts to be connected to the lampholder. The internal electrical interconnections of the lampholder can also be realised by wiring. The electrical contacts of the lampholder can each be of another construction or type, and can be made as a spring mounted or constructed metallic element for the resilient contact or clamping of an electrical pin, pen, wire, strip or similar contact of the electrical part to be connected, or of the electrical power supply, whereby the spring mounted or constructed element can be shaped in such a way, that the electrical contact of the electrical part to be connected can be brought into resilient contact with the spring element and can be disconnected from it by pulling back the pin or similar contact, or can be put into or taken out of the spring or clamping element so that respectively by pressing and sliding or clamping electrical contact is obtained.

The resilient electrical contacts of the lampholder, can push back the pin or similar contacts of the electrical part to be connected to the lampholder, for which it may be necessary for the electrical part to be mechanically locked, for which provisions can be made in the lampholder and the ballast. The resilient electrical contacts in the lampholder can be made so that the lampholder can be used for several types of ballasts, with the electrical pin or similar contacts in different sizes, distances and heights or positions, whereby in the connected situation of ballast and lampholder, the electrical pin or similar contacts of the ballast can be perpendicular to the relative resilient electrical contacts of the lampholder, which contacts can be constructed in the form of a strip.

The electrical contacts of the lampholder can be made with a spring element, so that the electrical contacts of the electrical parts to be connected can be inserted into it, but cannot be removed without eliminating the clamping and blocking action of the electrical contacts of the lampholder, for which provisions can be made in the lampholder.

The electrical contacts of the lampholder can also be made in such a way that the electrical contacts of the electrical parts to be connected to it, are clamped firmly by means of a screw, or another connecting device, whereby this screw can be fitted into the metal parts of the electrical contact of the lampholder, or can be fitted externally into the lampholder casing, whereby the screw can be made of non-conductive material, such as plastic. The electrical contact with the screw in the metal parts can be constructed in such a way, that the screw can be fitted into the metal parts, either before the electrical contact is fitted into de lampholder, or after the electrical contact has been fitted into the lampholder. The electrical contact of the lampholder with screw clamping can be made in such a way that the clamping referred to above is achieved by direct contact between screw and the electrical contact to be connected, or via a sheet as intermedium, which sheet can be a metal sheet and can be a part of the electrical contact of the lampholder. Provisions must, of course, be made in the lampholder so that the screw can be reached, with for example a screwdriver, when the lampholder is closed and when mounted in any lighting unit. The electrical contact of the lampholder can be carried out in such a way that the electrical pin, pen, wire, strip of similar contact is clamped between a metal part of the electrical contact in the lampholder and an inner-wall of the lampholder casing. For a simple fitting of the metal electrical contacts and of the internal metal electrical interconnections into the lampholder casing, which is still open, it is necessary to make the recesses with protrusions in the lampholder sections in such a way that the metal parts can be fitted into the lampholder sections, preferably, with a perpendicular movement.

According to the principles of the invention, there are various ways of designing and constructing the lampholder, therefore it is essential that the embodiments of the electrical contacts and the electrical interconnections should be constructed in such a way that many variations of the design of the lampholder can be realised, and for the manufacture, a flexible assembly technique can be used, with the use of simple standard components for the electrical contacts and by using a simple construction with few variations in shape and size for the electrical interconnections. By making the electrical contacts and electrical interconnections of a spring construction, or providing it with at least one spring element, they can be fitted into the lampholder sections in such a way, that when the lampholder sections are clamped together or clamped shut, the electrical contacts to be connected are electrically conneced together, whereby the spring action can also be achieved by using a spring mould-in construction element in the moulded sections of the lampholder. The internal electrical interconnections of the lampholder can consist of at least two parts, which can be placed in alignment, at any angle to each other or obliquely, whereby the relative electrical connection of the parts can be achieved by means of a spring element, whether or not fitted separately.

For the relative electrical contacts to make a good electrical connection, whether or not through a separate electrical interconnection and with or without the use of a spring element as described above, a welded joint can be achieved, for example by welding with a laser, which can be carried out after the metal parts are fitted into the lampholder and when the lampholder is in a closed position, which welding tehnique can be applied through the holes in the lampholder casing for the electrical contacts of the electrical parts to be connected to the lampholder. When using a separate printed circuit board, as described above, different variations in the shape of the printed circuit board can be realised by flexible manufacturing with the possible use of computer controlled laser beam or water jet cutting systems.

When the lampholder casing is manufactured in plastic by injection moulding, an injection moulding technology can be used, with known techniques, for the described spring construction elements to be moulded-in, such as for example by using screw type or detachable core parts, while a synthetic material can be used, which is technically suitable for the manufacture, construction and application of the lampholder casing. The relative electrical and mechanical connections between the PL lamp and lampholder can be realised by using the available constructions of the lamp cap of the PL lamp with pin electrical contacts as a basis, in addition to which, by means of any spring construction element in the lampholder, the lamp cap can, at least in one direction, be single-sidedly clamped in the lampholder, against a, preferably, three point carrying surface of the lampholder in such a way that the PL lamp can be fitted into the lampholder without noticeable play, whereby the spring construction element can be moulded-in the lampholder casing. The relative electrical and mechanical connections between ballast and lampholder can be realised by using the available constructions of the ballasts as a basis, whereby the ballasts are provided with at least two electrical pin, pen, wire, strip or similar contacts for the electrical connection, and possibly a base plate, on which the lampholder can be mechanically connected, for which existing or improved construction or fitting elements, such as one or more lips on the base plate, screws, nails or any clamping construction can be used, through which the lampholder base can be connected to the base plate, which existing construction or fitting elements are now being used for mounting an electrical terminal on the ballast for the purpose of making the electrical connections by means of wiring according to the current state of the art, while additionally also the screw for mounting the ballast to the surroundings can be used. Additional electrical contacts can be used for power control.

The mechanical connection of the lampholder to the base plate of the ballast, serves the purpose of forming a mechanical unit and of protecting the electrical pin, wire, strip or similar contacts of the ballast, from unwanted mechanical stress, for which the mechanical connection can be made in such a way, that at least the rear section of the lampholder casing is mechanically fitted to the base plate, which section preferably is connected to the electrical power supply wires.

For making the electrical and mechanical connections of the lampholder to a ballast with base plate, as described above, the electrical contacts of the lampholder to be connected to the ballast can be made in the form of an elongated slotform contact and clamped in such a way that the lampholder can be used for several types of ballasts, with the electrical pin, wire, strip or similar contacts in different sizes and positions. In addition, good electrical contacts can be obtained, in spite of the fact that the electrical pin, pen, wire, strip or similar contacts of the ballasts are often covered with a protective material such as paint or other non conductive material, by realising any scratching action on the electrical contacts of the ballast, from the electrical contact of the lampholder during clamping, either or not achieved by means of any screw pressing force. For the benefit of the mechanical connections of the lampholder to the base plate of the ballast as described above, certain provisions can be made in the lampholder base or mounting surfaces of the lampholder casing, so that the lampholder can be connected with one or more types of ballast with certain mechanical provisions.

The lampholder can be constructed in such a way that it serves as the central mounting device for all the parts which have to be connected to it, such as the ballast, the PL lamps with or without any separate starters, a possible reflecting or backing plate and the electrical power supply, in which in priniple, only the lampholder needs to be connected to the surroundings. Also power control parts can be lampholder connected.

The lampholder can be constructed in such a way that the connecting wires of the electrical power supply, namely the neutral wire and current supply wire, can be easily connected at any given but clearly recognisable point of the lampholder, with the aid of the known embodiments and devices for this purpose.

When mounting the lampholder into lighting fixtures, it is important to ascertain that the electrical contacts to be connected to the electrical power supply are accessible, whilst for structures of a lighting unit or fixture that are visible or open, however, preference may be given to connecting the electrical power supply wires to the base of the lampholder through an opening in the base plate, so that no wiring at all can be seen on the visible side or sides of a lighting unit, whereby if required, an additional cap can be used for covering the connecting wires or elements Provisions can be made, either in or on the lampholder, to relieve the pull on the connecting wires of the electrical power supply, for example by using any additional cap with any clamping device. The lighting unit or basic lighting unit, assembled with the aid of the lampholder, can be used for lighting purposes by placing the basic lighting unit in a visible position against a wall, or ceiling, or something similar without an additional covering glass plate or similar element. Alternatively the basic lighting unit could be built into lighting fixtures or parts of same. The electrical power supply can be a public as well as a local electrical power supply system, or can be an electrical power supply system in a vehicle, or a mobile or static generating system or similar source. For an embodiment of a basic lighting unit with visible structures, as described above, the lampholder can be constructed in such a way, that the lampholder forms an unit with any housing needed for the ballast, which housing can be combined with a reflecting or backing plate and made to fit the lampholder. A preferred embodiment can be used whereby the regulations applicable to lighting fixtures or units are complied with. The lampholder casing can be provided with at least one external recess so that the ballast, and separately or not any starter, which may have to be connected, fit into a recess, and whereby the external recess can be locked. The described lampholder can, of course, be applied for connecting any different kinds of electrical parts to each other and to the electrical power supply system, like parts of a power control system.

The invention does not, however, relate to the connecting pieces, hubs, blocks or housings, used to connect gas discharge or fluorescent lamps with an Edison screw fitting.

BRIEF DESCRIPTION OF THE DRAWINGS

These and other features of the invention will be better understood by reading the following detailed description taken together with the drawing, wherein.

DETAILED DECRIPTION OF THE INVENTION

The invention will be further explained by means of figures, in which embodiments are illustrated, where in accordance with the invention the FIGS. 3 to 23 inclusive are included in order to illustrate examples of possible embodiments of the invention, and does not have any restrictive character or function according to the invention. In the FIGS. 1 and 2 the current state of the art is illustrated, while these figures also illustrate the relative connecting diagrams.

Figure 1:
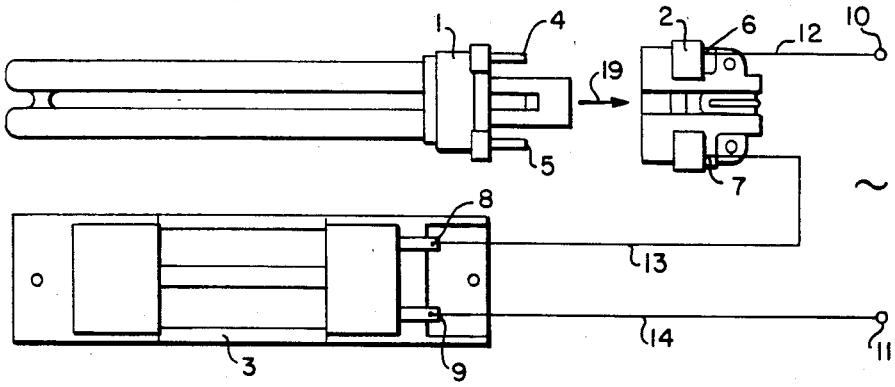
Fig. 1 PRIOR ART
FIG. 1 is an illustration of a prior art single lamp lighting system.

FIG. 1 is a top plan view of the electrical parts of a single-type PL lighting system according to the current state of the art, namely, PL lamp 1, the existing lampholder 2 and ballast 3, with the relative connecting diagram.

Figure 2:
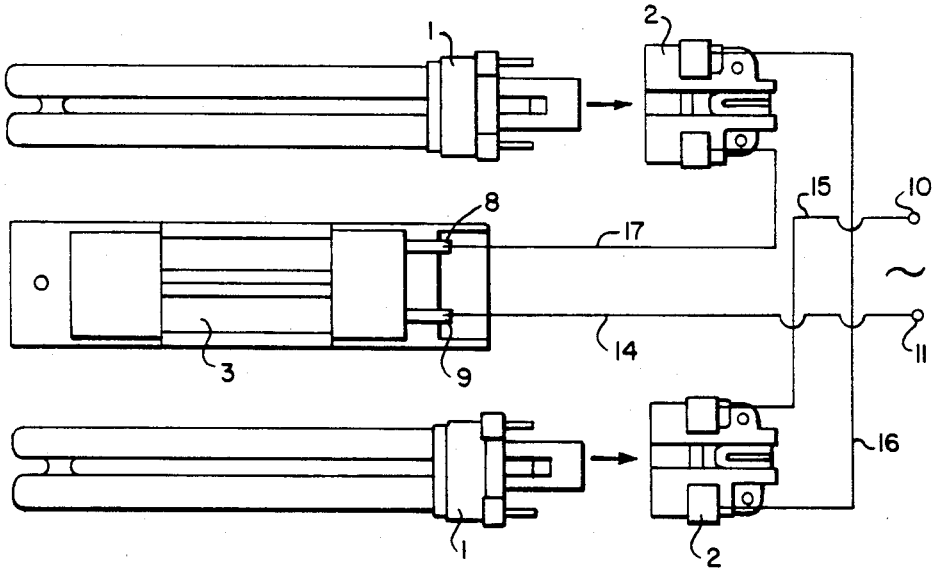
Fig. 2 PRIOR ART
FIG. 2 is an illustration of a prior art twin-type lamp lighting system.

FIG. 2 is a top plan view of the electrical parts of a twin-type PL lighting system according to the current state of art, namely, the two PL lamps 1, two existing lampholders 2 and ballast 3, with the relative connecting diagram.

Figure 3:
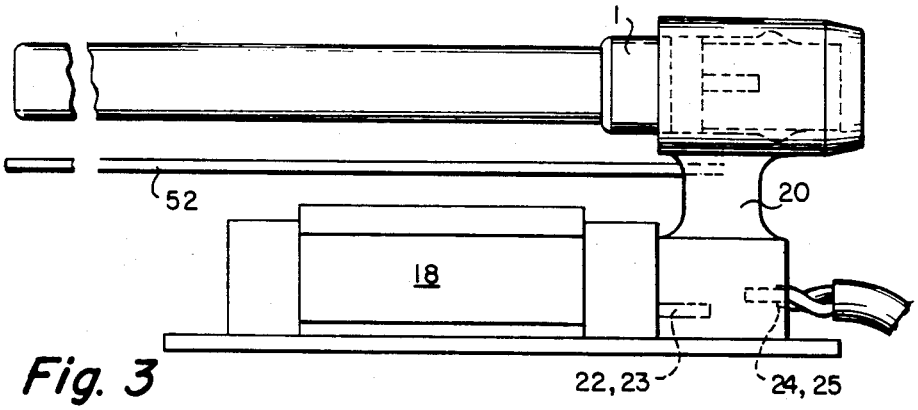
FIG. 3 is a side elevation view of one embodiment according to the present invention.

FIG. 3 is in accordance with the invention and gives a side elevation view showing a possible assembly arrangement with an example of a single-type lampholder for connecting a PL lamp to the electrical power supply and to a ballast accessory, in accordance with the relative connection diagram as given in FIG. 1, whereby in this example the PL lamp is located parallel to and above the ballast and whereby the lampholder is constructed in such a way that the electrical parts of the PL lighting unit shown here, namely, PL lamp 1, lampholder 20 and ballast 18 are directly connected to each other by means of electrical pin contacts, and connected to the electrical power supply.

Figure 4:
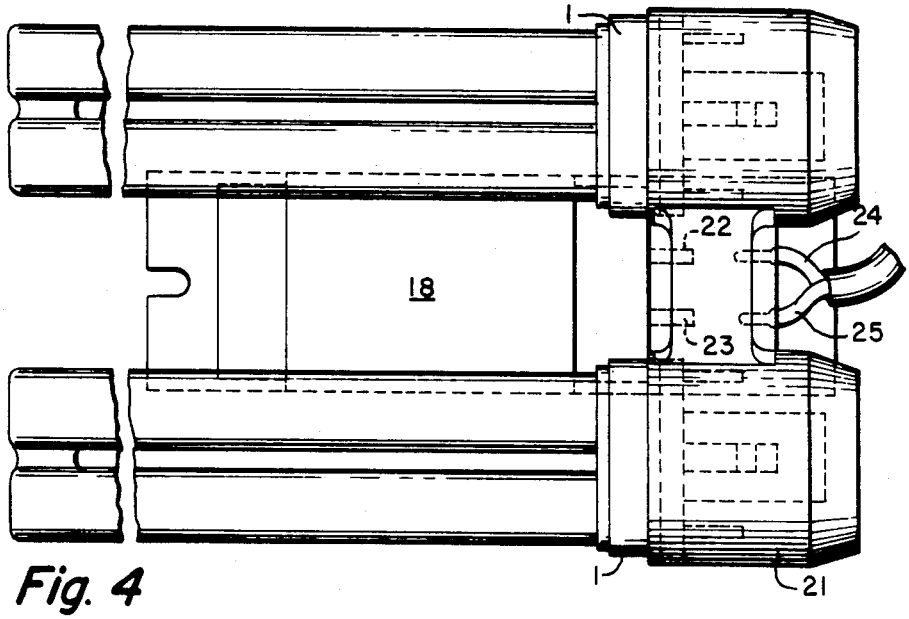
FIG. 4 is a top plan view of the embodiment of FIG. 3.

FIG. 4 is in accordance with the invention and gives a top plan view showing a possible assembly arrangement with an example of a twin-type lampholder for connecting two PL lamps to the electrical power supply and to a ballast accessory, in accordance with the relative connection diagram as given in FIG. 2, whereby in this example both the PL lamps are located parallel to each other above the ballast and whereby the lampholder is constructed in such a way that the electrical parts of the PL lighting unit shown here, namely, the two PL lamps 1, lampholder 21 and ballast 18 are directly connected to each other by means of electrical pin contacts, and to the electrical power supply.

Figure 5:
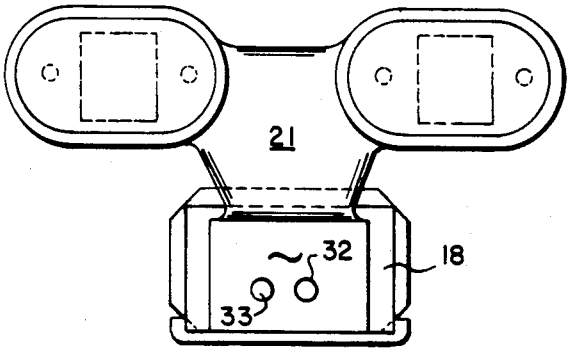
FIG. 5 is a rear elevation of a twin-type lamp holder according to the present invention.

FIG. 5 is in accordance with the invention and gives a possible back view of an example of a twin-type lampholder 21 as given in FIG. 4, whereby the lampholder is connected to the ballast 18.

Figure 6:
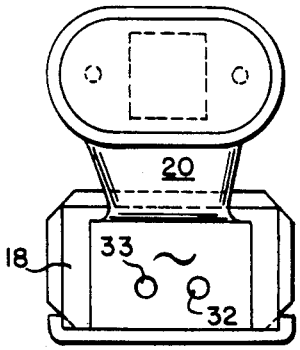
FIG. 6 is a rear elevation of a single lamp holder embodiment according to the present invention.

FIG. 6 is in accordance with the invention and gives a possible back view of an example of a single-type lampholder 20 as given in FIG. 3, whereby the lampholder is connected to the ballast !8.

Figure 7:
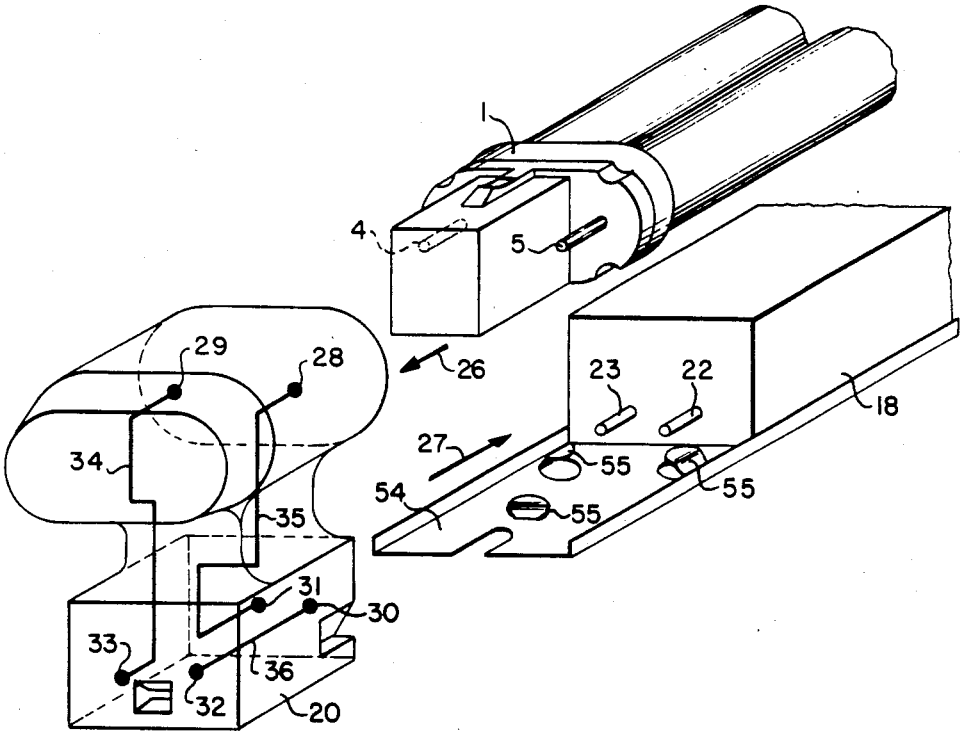
FIG. 7 is a perspective view of one embodiment according to the present invention showing the internal electrical connections.

FIG. 7 is in accordance with the invention and gives a perspective view of a possible assembly arrangement of a PL lighting unit, and of a transparent schematic diagram of a possible lampholder 20, projecting how the internal electrical interconnections can for example be brought into the interior of the single-type lampholder 20, which interconnections are in accordance with the connecting diagram of FIG. 1. The possible assembly arrangement shown in FIG. 7, also clearly illustrates, how the various electrical parts can be electrically and mechanically connected to each other, namely, lampholder 20 to ballast 18, and PL lamp 1 to lampholder 20.

Figure 8:
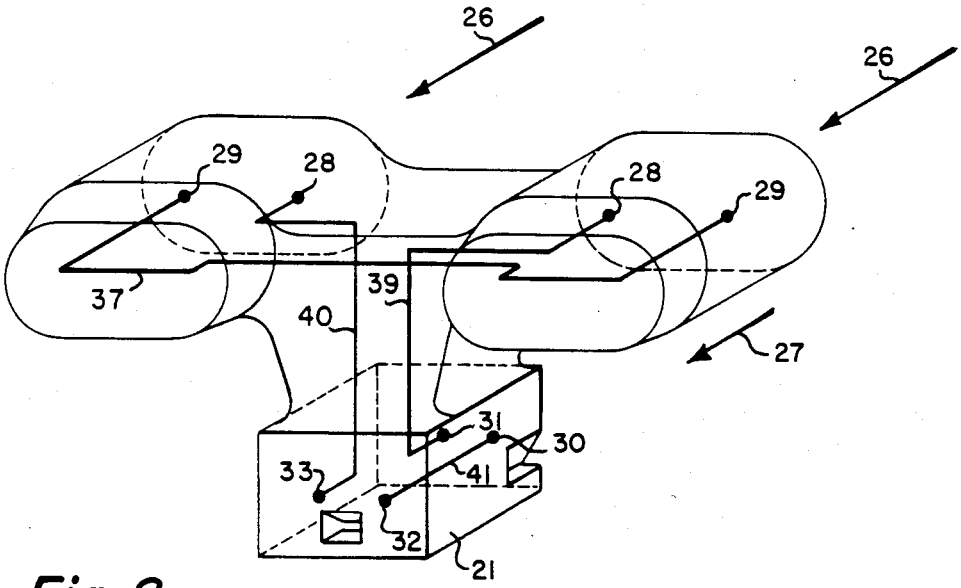
FIG. 8 is a perspective view of a twoin-type lamp holder embodiment according to the present invention showing the interconnections therein.

FIG. 8 is in accordance with the invention and gives a transparant perspective view of a possible schematic diagram, projecting how the internal electrical interconnections can for example be brought into the interior of the twin-type lampholder 21 also shown in FIGS. 4 and 5, whereby the interconnections are in accordance with the connecting diagram of FIG. 2. Lampholder 21 in the example of FIG. 8 can be electrically and mechanically connected to the ballast 18 in FIG. 7, in a similar manner to that of lampholder 20 and ballast 18, as illustrated in the example of FIG. 7.

Figure 9:
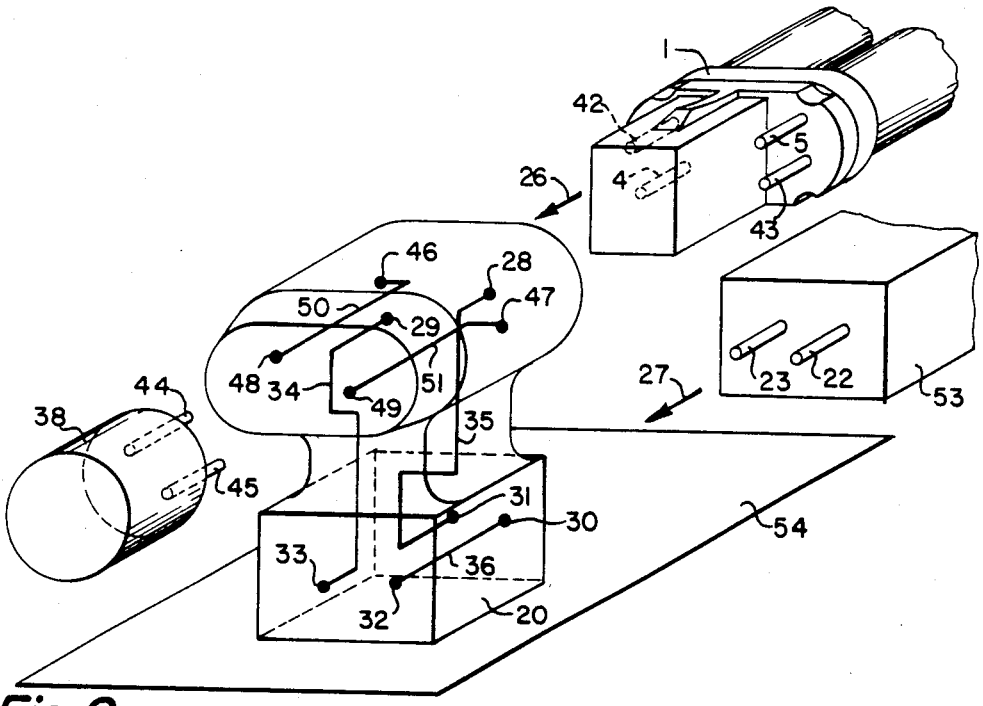
FIG. 9 is a perspective view of an alternate embodiment of the present invention showing the interconnections and provision for connection to a starter.

FIG. 9 is in accordance with the invention and gives a transparent perspective view of a possible embodiment of the lampholder 20, and gives a perspective view of a possible assembly arrangement, projecting a possible single-type lampholder 20, which is provided with an additional electrical connection, so that the lampholder 20 is adapted for connecting a PL lamp 1 without an integrated starter in the lamp cap, whilst a separate starter 38 can be connected to the lampholder at the additional electrical connection.

Figure 10:
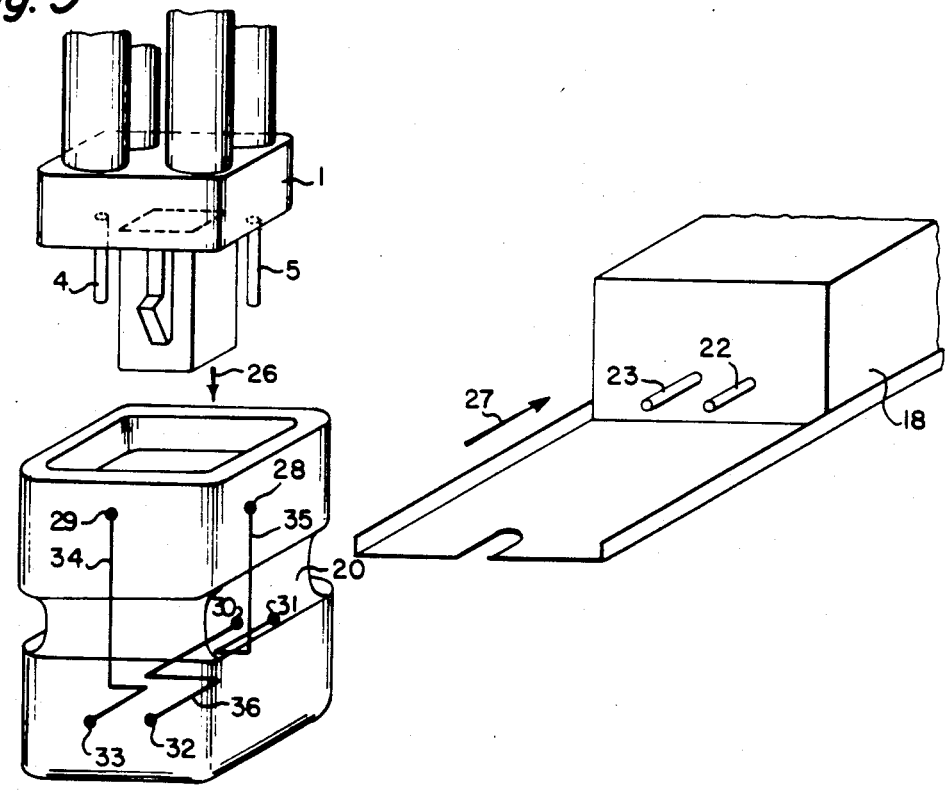
FIG. 10 is a perspective view of an alternate embodiment of the present invention, including a lampholder having an additional connection therein.

FIG. 10 is in accordance with the invention and gives a transparent perspective view of a possible embodiment of the lampholder, and gives a perspective view of a possible assembly arrangement projecting a possible single-type lampholder 20 which is suitable for a more compact arrangement of the PL lamp 1, whereby the PL lamp, when fitted into the lampholder is perpendicular to the ballast 18. The transparent perspective view of the possible lampholders 20 given in FIGS. 9 and 10, illustrates how, by incorporating principles of the invention, the electrical interconnections can be carried out in accordance with the relative connecting diagrams.

With regard to the possible assembly arrangements of the electrical parts to be connected, FIGS. 7 and 9 show two different embodiments. FIG. 7 shows a possible embodiment in which the ballast 18 has a base plate 54 with possible mechanical provisions 55 for connecting lampholder 20 mechanically to the ballast 18, so that the possible basic lighting unit thus formed, comprising lampholder 20 and ballast 18, can for example be built into a lighting fixture, for example, by means of the base plate of the ballast. FIG. 9 shows a possible embodiment in which the lampholder 20 forms the central device and all the other electrical parts, namely, PL lamp 1, ballast 53 and starter 38 can be connected to it by means of, for example, electric plug or similar contacts, whereby the possible lampholder 20 can also be connected to a possible base plate 54 or a part of a lighting fixture, for the benefit of creating a basic lighting unit, which can be built into a lighting fixture if required.

In conjunction with both the schematic electrical connection diagrams of FIGS. 1 and 2, according to the current state of the art, and the possible embodiments of the lampholder in the FIGS. 3 to 10 inclusive, according to the invention, an explanation of the various internal electrical interconnections and the electrical contacts of some possible lampholder embodiments will be given below.

According to the relative connecting diagram for connecting one PL lamp to the electric power supply, the ballast and PL lamp are connected in series to the electric power supply, and according to the relative connecting diagram for two PL lamps, both of the PL lamps and the relative ballast are connected in series to the electric power supply. A separate starter, if required, is connected parallel to the lamp. Indeed, it makes no difference to the basic principles of the invention if the connections are made in series, parallel, or a combination of both.

Because PL lamp and ballast are connected in series, the functioning of the lamp is not influenced if the current supply wire is connected to point 10 or 11 in FIGS. 1 and 2, and correspondingly to point 32 or 33 in FIGS. 5 to 10 inclusive.

Functionally the connecting points of the current supply wire and the neutral wire are normaly interchangeable. For safety reasons it is most important how the interconnections and electrical contacts are carried out. This will be explained at a later stage.

A more detailed description of the various interconnections and electrical contacts now follows, from which the relationship between the various components in the various drawings will be apparent.

According to the current state of the art, when connecting a PL lamp to a ballast as in FIG. 1, after the PL lamp 1 has been fitted into the existing lampholder 2 arrow 19, the electric circuit is closed by means of the following components in succession, namely, connecting point 10, connecting wire 12, two-sided electrical clamp contact 6 in the existing lampholder 2, electrical pin contact 4 of the PL lamp 1, by way of lamp 1 from electrical pin contact 4 to electrical pin contact 5, electrical pin contact 5, two-sided electrical clamp contact 7 in the existing lampholder 2, connecting wire 13, electrical terminal contact 8, form electrical terminal contact 8 to electrical terminal contact 9 by way of the winding of ballast 3, electrical terminal contact 9, connecting wire 14, connecting point 11. According to the current state of the art, when connecting two PL lamps and a ballast to the electrical power supply as in FIG. 2, the electric circuit between connecting points 11 and 10 and the electrical parts connected in series are formed by attaching the connecting wires 14, 17, 16 and 15.

To connect the connecting wires to the electrical terminal contacts 8 and 9 of ballast 3 in FIGS. 1 and 2, the ballast in the current state of the art is normaly is provided with a terminal block. With the principles of the invention incorporated in the lampholder as in FIGS. 3 and 4, the wires 24 and 25, namely the current supply wire and the neutral wire, form the connection to the electrical power supply, whereby the ballast is connected to the lampholder by means of electrical pin contacts 22 and 23, for example.

In the embodiments in FIGS. 3 to 10 inclusive, the connecting wires 24 and 25 of the electrical power supply in FIGS. 3 and 4, are connected to the electrical contacts 32 and 33 of the lampholder in FIGS. 5 to 10 inclusive, and the electrical pin contacts 22 and 23 of the ballast in FIGS. 7, 9 and 10, arrow 27 in FIGS. 7 to 10 inclusive, are connected to electrical contacts 30 and 31 of the lampholder in FIGS. 7 to 10 inclusive. The embodiments in FIGS. 7 to 10 inclusive, also show how the PL lamp can be fitted into the lampholders 20 and 21, see arrow 26, whereby the electrical pin contacts 4 and 5 of the PL lamp 1 in FIGS. 7, 9 and 10 form a connection with the relative electrical contacts 28 and 29 of the lampholder in FIGS. 7 to 10 inclusive.

Because, functionally, the current supply wire of the electrical power supply can be connected to electrical contact 32 as well as electrical contact 33, for reasons of safety, however, it is better for the electrical contacts 30 and 31 to have a two point connector in the form of any electric clamp or similar contacts, for connecting the ballast, whereby for the corresponding electrical contacts on the ballast, a two point plug connection in the form of electrical pins, wires, strips or similar contacts should be provided.

Because the lampholder's electrical connections for the electrical power supply and the ballast are part of a connection in series, it is in principle possible in the lampholder 20 in FIG. 9, to connect ballast 53 to electrical contact 32 and 33, and the electrical power supply to electrical contact 30 and 31, through which there are, thus, two possibilities for connecting the ballast to the lampholder, which can be advantageous when mounting the lampholder in lighting fixtures. In the possible embodiments of single type lampholders in FIGS. 7, 9 and 10, the connection between the electrical contacts 28 and 31 is for example, made by the internal electrical interconnection 35, between electrical contacts 29 and 33, for example, by the internal electrical interconnection 34 and between electrical contacts 30 and 32, for example by the internal electrical interconnection 36. In the possible embodiment of the twin-type lampholder in FIG. 8, the connections in the lampholder with the electrical contacts 32 and 33 and the electrical contacts 30, 31, 28 and 29 for the electrical parts to be connected to the lampholder, namely ballast and PL lamps, are, for example, made by the internal electrical interconnections 41, 39. 37 and 40, whereby correspondingly, interconnection 41 forms the connection between the electrical contacts 32 and 30, interconnection 39 forms the connection between electrical contact 31 and one of the electrical contacts 28, interconnection 37 forms the connection between both the electrical contacts 29, and interconnection 40 forms the connection between the electrical contacts 28 and 33. The above descriptions also indicate how, with the use of the invention, the electric circuits of the PL lighting units in FIGS. 3 to 10 inclusive, are closed.

In the embodiment in FIG. 9, for example, the lampholder 20 is provided with additional internal electrical interconnections 50 and 51 and electrical contacts 46, 47, 48 and 49, so that by means of for example electrical pin or similar contacts 44 and 45, the separate starter 38 can be connected through lampholder 20 to the additional electrical pin or similar contacts 42 and 43 on the relative PL lamp 1, without integrated starter in the lamp cap.

The single and twin-type lampholders 20 and 21, shown in perspective in FIGS. 7 to 10 inclusive, can, with the exception of the internal electrical interconnections and the electrical contacts, be completely, or partly, made of plastic or something similar.

In conjunction with the possible example of the single-type lampholder in FIG. 7, and in conjunction with the possible embodiments of the lampholder in FIGS. 11 to 23 inclusive, in accordance with the invention, an explanation will be given below, of possible embodiments and constructions of the lampholder assembly and their possible electrical contacts and internal electrical interconnections.

Figure 11:
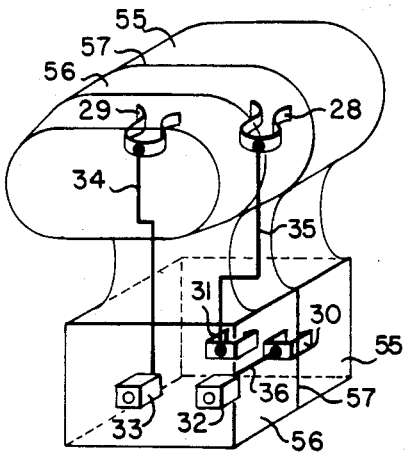
FIG. 11 is a perspective view of one embodiment of the present invention showing the electrical connections within a lampholder having two sections and a common tangent plane.
Figure 12:
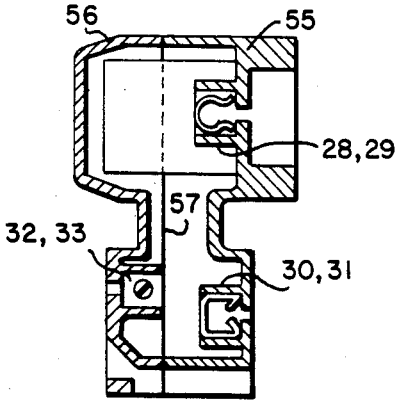
FIG. 12 is a cross sectional view of the lampholder according to FIG. 11.

FIGS. 11 and 12 are in accordance with the invention and gives, respectively, a transparent perspective view, and a cross-section of the lampholder in FIG. 7, showing that the recesses and such can be constructed so that as little as possible material is used, whereby space is created for fitting the possible electrical contacts 28, 29, 30, 31, 32 and 33 and the possible internal electrical interconnections 34, 35 and 36 in the interior of the lampholder, whereby the lampholder comprises, for example, of two sections 55 and 56, with a common tangent plane 57.

The internal electrical interconnections 34, 35 and 36 are, in principle, made of an electrically conductive material and can be constructed as metal wires, strips or similar, or as a printed circuit.

Figure 13:
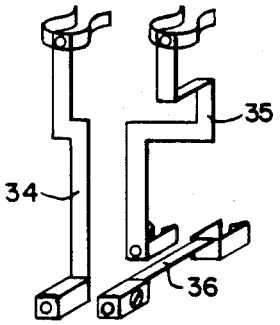
FIG. 13 is a perspective view of the metal parts comprising the electrical connection according to one embodiment of the present invention.

FIG. 13 is in accordance with the invention and shows a possible embodiment of the internal electrical interconnections in which the metal parts 34, 35 and 36 are connected to or integrated with the relative electrical clamp contacts, which integrated parts thus formed can be fitted to the recesses of the lampholder shown in FIGS. 11 and 12.

Figure 14:
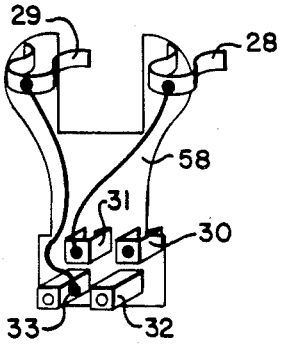
FIG. 14 is an alternate embodiment according to the present invention having the connectors are mounted on a printed circuit board.

FIG. 14 is in accordance with the invention and shows a possible embodiment in which the electrical clamp contacts 28, 29, 30, 31, 32 and 33 are mounted on a printed circuit board 58, which can be fitted into the interior of the lampholder shown in FIGS. 11 and 12.

Figure 15:
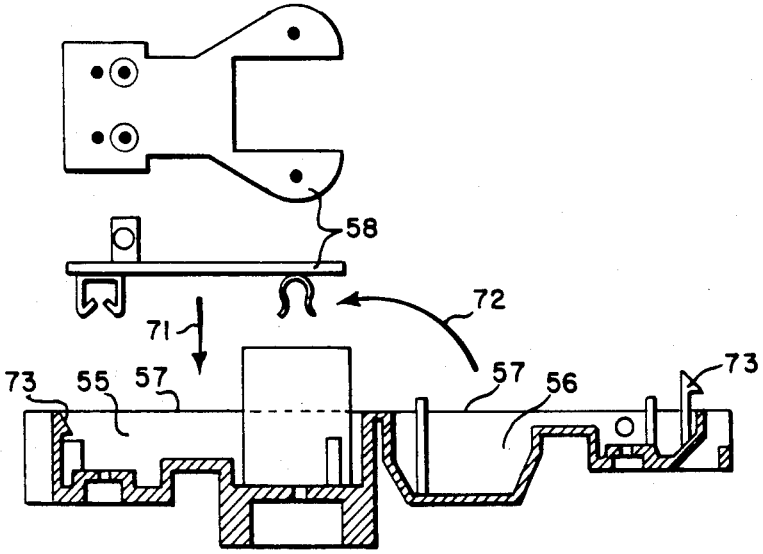
FIG. 15 is an alternate embodiment of the present invention having the electrical circuit connections retained within two hinged sections of a plastic lampholder casing.

FIG. 15 is in accordance with the invention and shows a possible embodiment comprising two sections 55 and 56, which are hinged together, can be clamped together and can be constructed as injection moulded plastic lampholder casing, whereby a separate printed circuit board 58 is applied with attached electrical contacts and electrical interconnections, whereby arrow 71 indicates how the printed circuit board 58 can be fitted into lampholder section 55, whereafter the lampholder casing can be clamped shut, as indicated by arrow 72, at the common tangent plane 57, whereby the lampholder sections can be interlocked by the hook shaped moulded-in locking mechanism 73.

Figure 16:
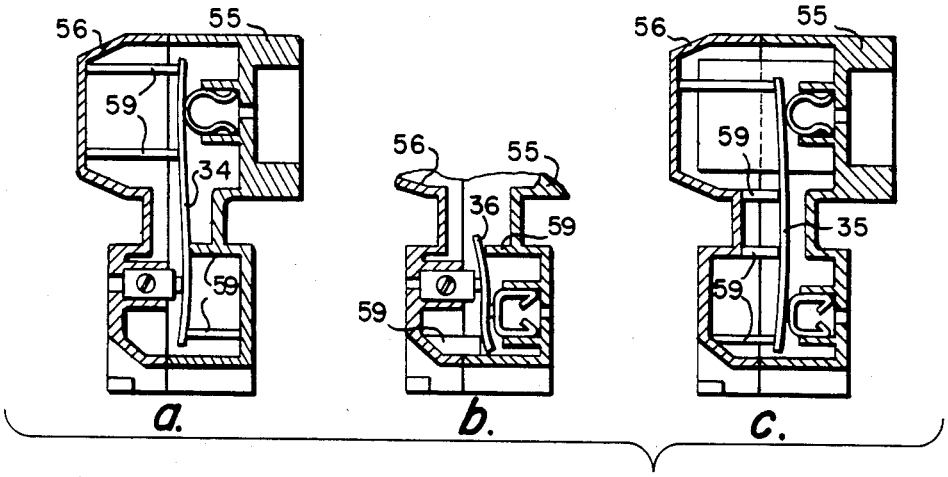
FIGS. 16A, 16B and 16C show the internal electrical connections of three embodiments according to the present invention.

FIG. 16 is in accordance with the invention and shows three examples of embodiments a, b and c, of the internal electrical interconnections 34, 36 and 35 in the form of spring-mounted, straight, flat metal strips, whereby the lampholder sections 56 and 55 have moulded-in protrusions 59, so that when these sections 56 and 55 are clamped together or shut, the electrical metal spring interconnections make good electrical contact with the electrical clamp contacts that are to be electrically connected together, whereby however, it is also possible to make the protrusions of a mould-in or separate spring construction, that can located in recesses opposite the relative electrical clamp contacts.

Figure 17:
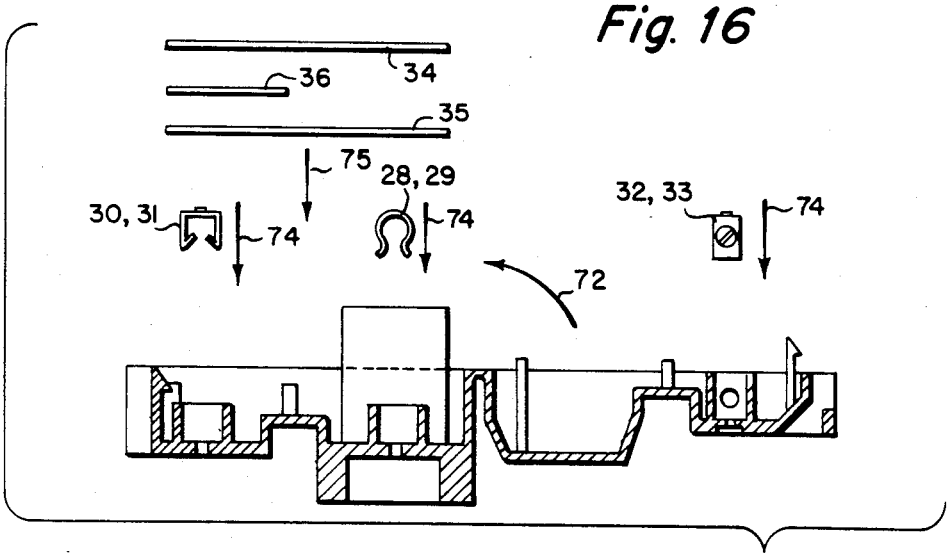
FIG. 17 provides an alternate embodiment according to the present invention, injection-molded plastic lampholder casings.

FIG. 17 is in accordance with the invention and shows an example of an embodiment similar to FIG. 15, comprising two hinged sections, constructed as an injection mouldingcasing in plastic which can be clamped together, whereby the electrical contacts, 28, 29, 30, 31, 32 and 33 are fitted in the recesses with protrusions in the lampholder sections, as indicated by arrow 74, whereafter the electrical interconnections 34, 35 and 36, here shown as metal strips, can be fitted into he recesses with protrusions, as illustrated by arrow 75, after which the lampholder can be clamped shut to realise the relating electrical connections in the lampholder.

Figure 18:
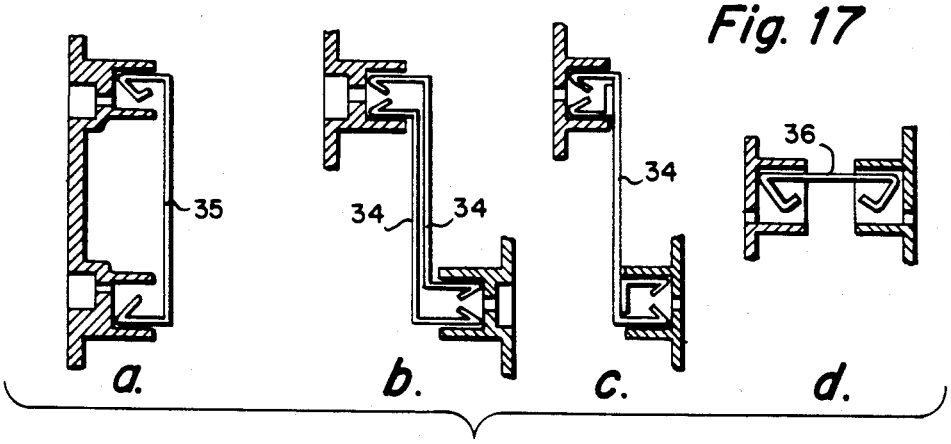
FIGS. 18A, 18B, 18C and 18D are the electrical interconnections of an alternate embodiment according to the present invention.

FIGS. 18 *a*, *b*, *c* and *d* are in accordance with the invention and show examples of embodiments whereby the electrical interconnections 35, 34 and 36 are integrated with the electrical clamp contacts to be connected together electrically. An electrical interconnection can also be integrated with an electrical contact by means of welding, for example, or other joining techniques.

Figure 19:
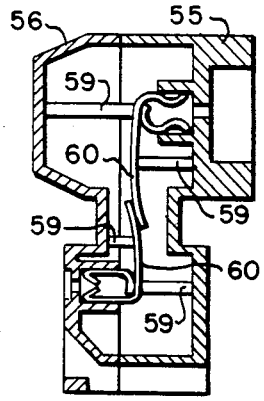
FIG. 19 is an alternate embodiment of the present invention showing integrated internal electrical interconnection.

FIG. 19 is in accordance with the invention and shows a possible embodiment of the electrical interconnection between two electrical clamp contacts, whereby the electrical connection is achieved by providing at least one of the clamp contacts with a spring construction element 60, so that when the lampholder sections 56 en 55 are clamped together, both clamp contacts will be electrically connected by means of, for example, the spring construction element 60 and through pressure from the protrusions 59. In fact the electrical interconnection of the example of FIG. 19 is split into two parts, which parts are integrated with their relative electrical clamp contacts.

Figure 20:
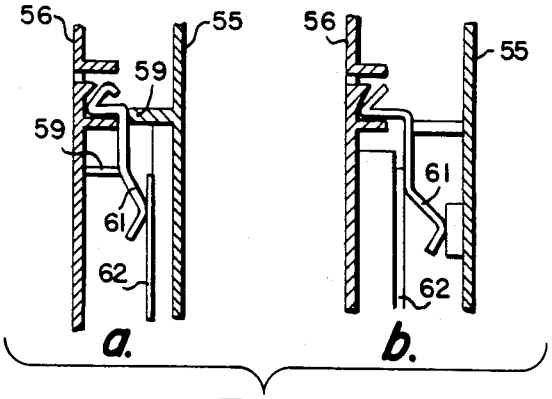
FIGS. 20A and 20B are alternate embodiments of the present invention having spring elements communicating with the internal electrical elements.

FIGS. 20 *a* and *b* are in accordance with the invention and give examples of embodiments, showing an electrical connection between an electrical clamp contact and the internal electrical interconnection 62, whereby the clamp contact is provided with a spring contruction element 61, so that when the lampholder sections 56 and 55 with protrusions 59 are clamped together or shut, the electrical clamp contact will be electrical connected with the electrical interconnection 62 by means of the spring construction element 61, whereby for the electrical interconnection 62 on one of the lampholder sections, a metal strip, a conductive layer or a printed circuit for example can be used.

Figure 21:
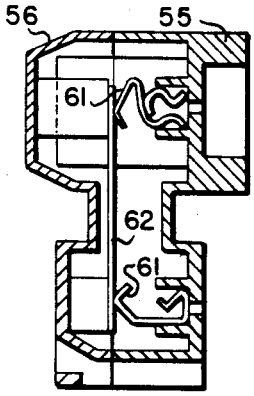
FIG. 21 is an alternate embodiment of the present invention wherein spring elements are disposed to provide electrical contact when lampholder sections are in locked position.
Figure 22:
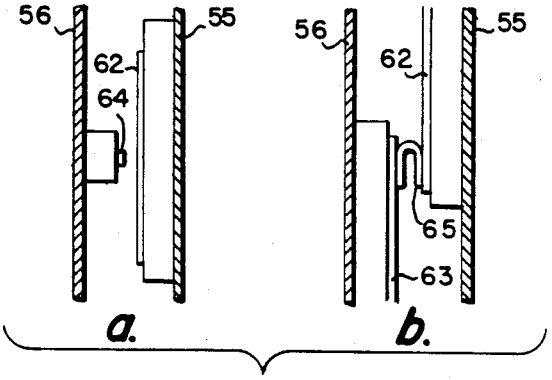
FIGS. 22A and 22B are illustrations according to one embodiment of the present invention of electrical interconnection between the lampholder sections.
Figure 23:
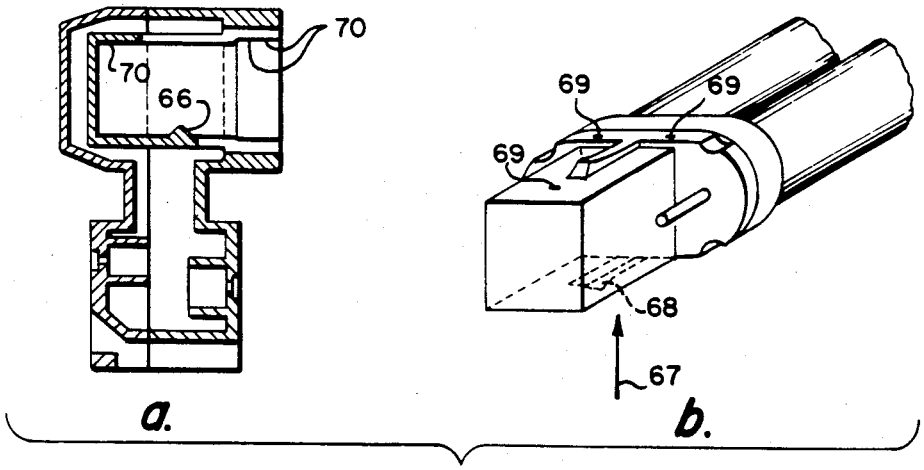
FIGS. 23A and 23B are drawings of mating lampholder and lamp cap elements, respectively, of an alternate embodiment of the present invention.

FIG. 21 is in accordance with the invention and gives an example of another embodiment in accordance with the principles of FIG. 20, whereby the electrical contacts are provided with spring construction elements 61, which make the electrical connection with the electrical interconnection 62, when the lampholder sections 55 and 56 are in the locked position.

FIGS. 22*a* and 22*b* are in accordance with the invention, where FIG. 22*a* illustrates how the internal electrical interconnection 62, attached to a protruding edge of one lampholder section 55, can cross the internal electrical interconnection 64, attached to a protruding edge of the other lampholder section 56, and FIG. 22*b* illustrates how the internal electrical interconnection 62 on a protruding edge of the one lampholder section 55, can be connected to the internal interconnection 63 on the protruding edge of the other lampholder section 56 by means of a spring construction element or device 65.

FIGS. 23*a* and 23*b* are in accordance with the invention and give a possible embodiment of the mechanical fitting construction of the lampholder for fitting the PL lamp into the lampholder, whereby the lampholder in FIG. 23*a* is provided with a mould-in spring construction element 66, so that when the lamp cap in FIG. 23*b* is fitted into the lampholder, the surface of the lamp cap with the three points 69 is pressed against the opposite surface of the lampholder with the three points 70, by means of a press-force on the lamp cap at the point 68, generated by spring construction element 66 in the direction of arrow 67, which results in a free of play fitting in one direction, which is important for the correct positioning of the PL lamp in relation to a reflecting or backing plate which can be part of the lighting unit, as in FIG. 3 in which the reflecting or backing plate 52 is connected to the lampholder 20.

I claim:

1. For use with a ballast and at least one of a loop-, u-, and pi-shaped gas discharge lamp having a lamp cap, a lampholder assembly comprising:

a unitary housing including
- means for receiving said lamp cap,
- means for receiving said ballast, and
- means for connecting to an electrical power supply; and electrical interconnections contained within said unitary housing for providing an electrical circuit between lamp cap, said ballast, and said electrical power supply.

2. A lampholder assembly as claimed in claim 1, characterized in that the lampholder is provided with additional internal electrical interconnections (50, 51) and additional electrical contacts (46, 47, 48, 49), so that a separate starter accessory for the loop-, u- or pi-shaped gas discharge or fluorescent lamp cam be connected to the lampholder.

3. A lampholder assembly as claimed in claim 1, characterized in that the lampholder is constructed in such a way that the loop-, u- or pi-shaped gas discharge or fluorescent lamp and the ballast are located next to each other in vertical alignment in the finished lighting unit.

4. A lampholder assembly as claimed in claim 1, characterized in that the internal electrical interconnections are moulded-in with the electrical contacts in the lampholder.

5. A lampholder assembly as claimed claim 1, characterized in that the lampholder can be connected to the ballast by means of electrical pin, wire or strip contacts of the ballast.

6. A lampholder assembly as claimed in claim 1, characterized in that the ballast can be connected to the lampholder by means of electrical pin, wire or strip contacts.

7. A gas discharge lamp fixture, comprising:

a ballast having electrical connectors thereon;

a unitary housing including
- means for receiving a gas discharge lamp,
- means for receiving said ballast connectors, and
- means for connecting to an electrical power supply; and electrical interconnections contained within said unitary housing for providing an electrical circuit between said gas discharge lamp, said ballast connectors and said electrical power supply.

* * * * *